US007191775B1

(12) United States Patent
Lo

(10) Patent No.: US 7,191,775 B1
(45) Date of Patent: Mar. 20, 2007

(54) GUN REPLICA

(76) Inventor: Wen-Ho Lo, No. 359, Jhongshan Rd., North Dist., Taichung (TW)

( * ) Notice: Subject to any disclaimer, the term of this patent is extended or adjusted under 35 U.S.C. 154(b) by 0 days.

(21) Appl. No.: 11/271,391

(22) Filed: Nov. 12, 2005

(51) Int. Cl.
*F41B 11/00* (2006.01)

(52) U.S. Cl. ..... 124/65; 124/66; 124/67; 124/68

(58) Field of Classification Search ..... 42/75.02, 42/75.03; 124/63–68
See application file for complete search history.

(56) References Cited

U.S. PATENT DOCUMENTS 5,173,564 A * 12/1992 Hammond, Jr. ..... 42/75.03

* cited by examiner

*Primary Examiner*—Michael J. Carone
*Assistant Examiner*—Gabriel J. Klein
(74) *Attorney, Agent, or Firm*—Hershkovitz & Associates; Abe Hershkovitz

(57) ABSTRACT

A gun replica includes a grip portion, a gun butt portion detachably connected to the grip portion and a cylinder portion received in a barrel portion which is detachably connected to the grip portion and having a piston movably received inside the cylinder portion so as to press a recoil mechanism and to compress air inside the cylinder of the cylinder portion to fire a bullet from the cartridge.

3 Claims, 3 Drawing Sheets

GUN REPLICA

BACKGROUND OF THE INVENTION

1. Field of the Invention

The present invention relates to a gun replica, and more particularly to a gun replica having parts detachably connected together so that the user is able to easily assemble/disassemble the gun replica.

2. Description of Related Art

A conventional gun replica, as shown in FIG. 3, especially the one used in war game or jungle surviving game, normally is provided with an outer casing (60) to receive therein the firing mechanism and a barrel portion (61) detachably connected to the casing (60) via pins extending through aligned holes respectively defined in the outer casing (60) and the barrel portion (61).

When this type of gun replica is experiencing a malfunction in either the firing mechanism inside the outer casing (60) or the cylinder inside the barrel portion (61), the user will have to first disassemble the barrel portion (61) from the outer casing (60). Then the user will have to disassemble the outer casing (60) piece by piece to see if the firing mechanism is faulty. Or the user will have to examine the cylinder to see if the cylinder is jammed after the barrel portion (61) is disassembled into pieces. That is, either before or after the troubleshooting procedure, the user will have to go through a lot of unnecessary trivial steps in order to have access to the correct elements, which is too troublesome for the user, especially during the middle of a war game.

To overcome the shortcomings, the present invention tends to provide an improved gun replica to mitigate the aforementioned problems.

SUMMARY OF THE INVENTION

The primary objective of the present invention is to provide an improved gun replica having easily assembled modules so that the user is able to easily have access to the elements in question.

In a different objective of the present invention, the gun replica is divided into a grip portion, a gun butt portion detachably connected to the grip portion, a barrel portion detachably mounted on top of the grip portion, a cylinder portion slidably received in the barrel portion and a recoil mechanism sandwiched between the gun butt portion and the cylinder portion to provide recoil force to a piston inside the cylinder so that the piston is able to compress air inside the cylinder portion and to fire bullet from the cartridge out of the barrel.

In another objective of the present invention, the grip portion is provided with a gear assembly driven by a motor which is received in the grip of the grip portion so that the piston of the cylinder portion is driven to retrograde. Thus the recoil mechanism is compressed.

Other objects, advantages and novel features of the invention will become more apparent from the following detailed description when taken in conjunction with the accompanying drawings.

DETAILED DESCRIPTION OF THE PREFERRED EMBODIMENT

Figure 1:
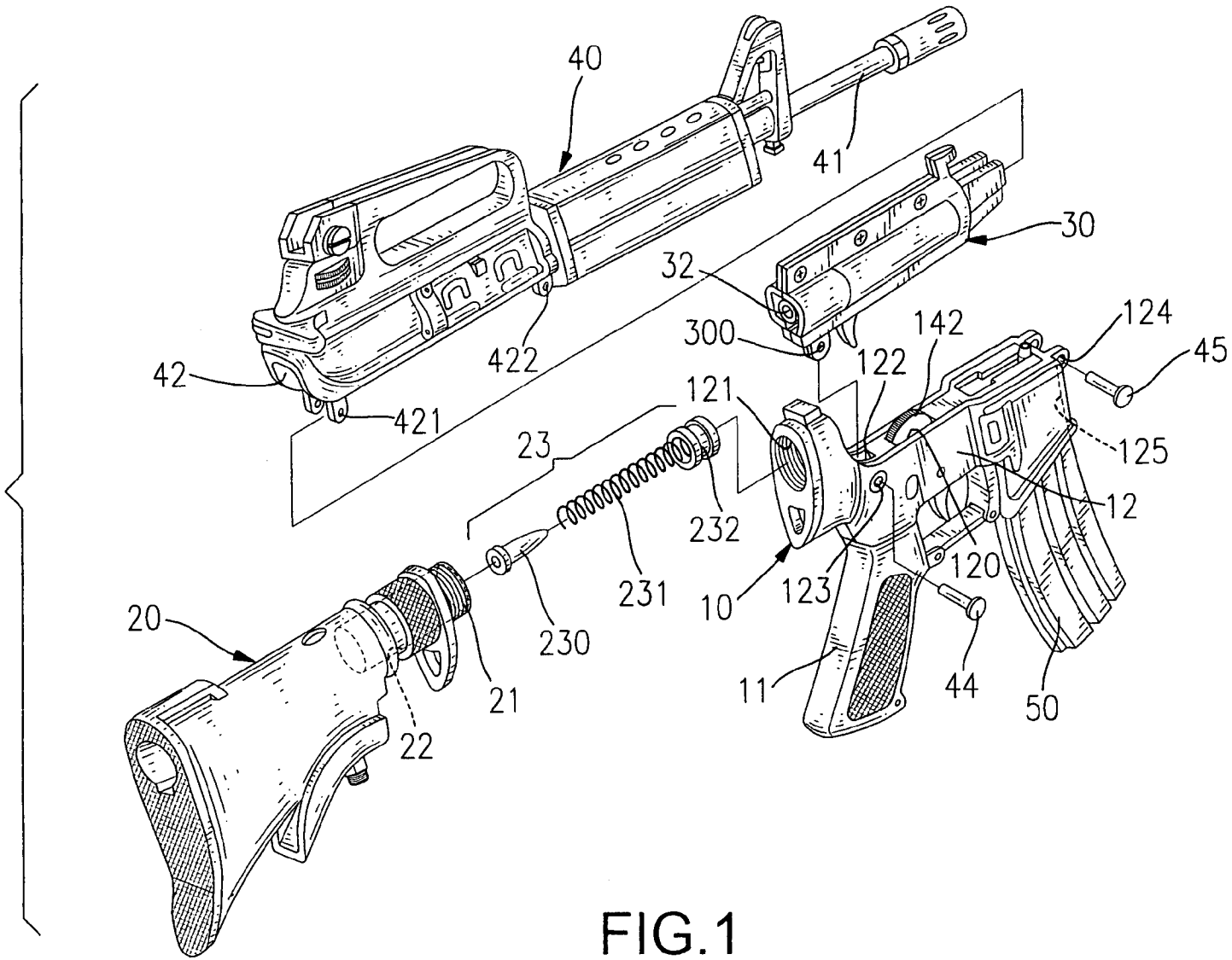
FIG. 1 is an exploded perspective view of the gun replica of the present invention.
Figure 2:
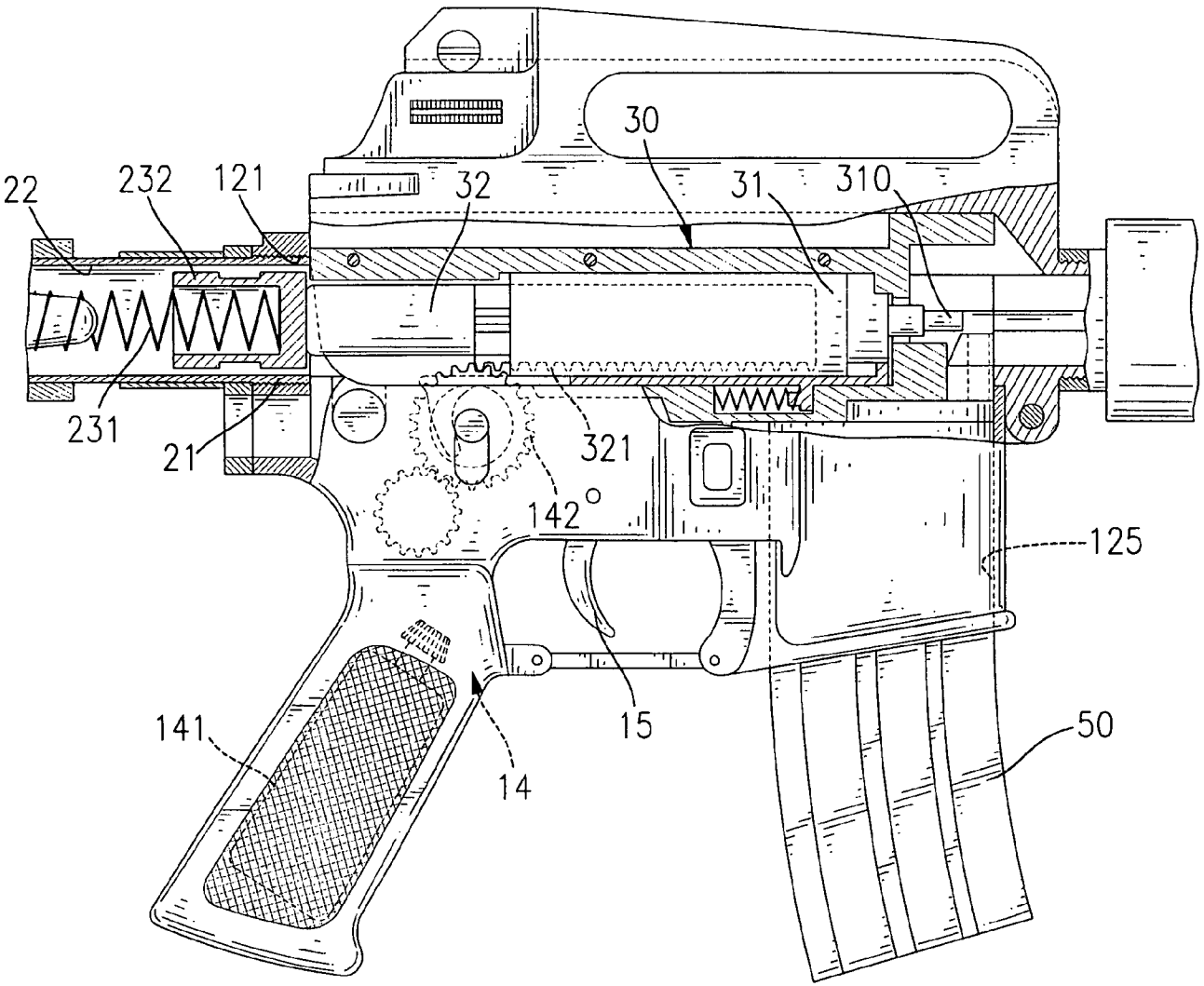
FIG. 2 is a partial schematic cross sectional view showing the internal structure of the gun replica after assembly.
Figure 3:
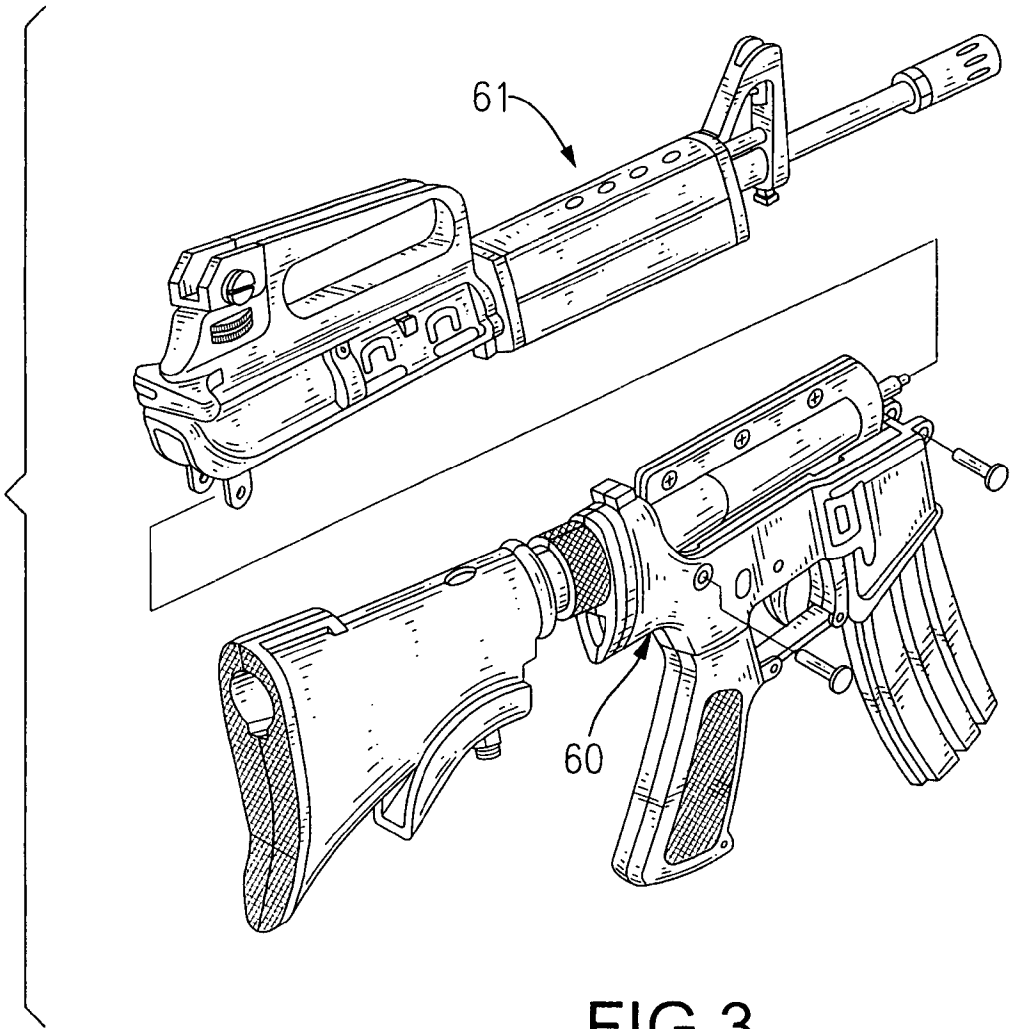
FIG.3 PRIOR ART
FIG. 3 is an exploded perspective view of a conventional gun replica.

With reference to FIGS. 1 and 2, it is noted that the gun replica in accordance with the present invention includes a grip portion (10), a gun butt portion (20), a cylinder portion (30) and a barrel portion (40).

The grip portion (10) includes a grip (11) extending out of a body (12) of the grip portion (10), a threaded bore (121) defined in the body (12), a receiving space (122) defined inside the body (12) to receive therein a gear assembly (14) which is composed of a motor (141) securely received in the grip (11) and a driving gear (142) exposed from the receiving space (122), a rear connection hole (123) defined through opposite sides of a rear portion of the body (12) to communicate with the receiving space (122), a front hole (124) defined through opposite sides of a front portion of the body (12) and a cartridge slot (125) defined in a bottom face of the body (12) to receive therein a cartridge (50).

The gun butt portion (20) includes a threaded extension (21) to correspond to the threaded bore (121) to combine the gun butt portion (20) with the grip portion (10), a recess (22) defined in the extension (21) to receive therein a recoil mechanism (23) which is composed of a guiding rod (230), a recoil spring (231) mounted around the guiding rod (230) and a distal end of which is securely connected to a bottom of the guiding rod (230) and a sleeve (232) securely connected to a proximal end of the recoil spring (231).

The cylinder portion (30) includes an assembly hole (300) defined in a bottom face thereof, a cylinder (31), a nozzle (310) defined in a front end of the cylinder (31) to allow air inside the cylinder (31) to escape, a piston (32) movably received inside the cylinder (31) to selectively compress the air inside the cylinder (31) and a rack (321) formed on a bottom face of the piston (32).

The barrel portion (40) has a barrel (41), a recessed area (42), a rear assembly hole (421) defined in a rear bottom face of the barrel portion (40) to correspond to the assembly hole (300) of the cylinder portion (30) and the rear connection hole (123) of the grip portion (10) and a front assembly hole (422) defined in a front bottom face of the barrel portion (40) to correspond to the front connection hole (124) of the grip portion (10).

When the gun replica of the present invention is assembled, the recoil mechanism (23) is first received in the recess (22) of the gun butt portion (20) which in turn is connected to the grip portion (10) via engagement between the threaded extension (21) into the threaded bore (121). After the cylinder portion (30) is received and fixed in the recessed area (42) of the barrel portion (40), the combination of the barrel portion (40) and the cylinder portion (30) is connected to the combination of the grip portion (10) and the gun butt portion (20) via a first pin (44) riveted into aligned rear connection hole (123) of the grip portion (10), the assembly hole (300) of the cylinder portion (30) and the rear assembly hole (421) and a second pin (45) riveted into aligned front connection hole (124) and the front assembly hole (422) such that the assembly of the gun replica of the present invention is finished.

When the gun replica is in use, the motor (141) inside the grip (11) is able to drive the piston (32) to move toward the recoil mechanism (23) via engagement between the driving gear (142) and the rack (321) on the bottom of the piston (32) such that the recoil mechanism (23) is compressed to store therein a resilience force to urge the piston (32) forward. After the trigger (15) is activated to release the piston (32), the piston (32) experiencing the resilience force from the recoil mechanism (23) moves forward to compress air inside the cylinder (31). Simultaneously, the bullet on top of the cartridge (50) is fired out of the nozzle (110) and out of the barrel (41) by the compressed air.

From the above description, it is noted that the gun replica is able to be assembled section by section so that the user may disassemble only the section that is malfunctioned without going through a lot of unnecessary steps to have access to the elements. In addition, the assembly/disassembly process is similar to a real gun, which further increases interests for players.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A gun replica comprising:

a grip portion having a body, a grip extending downward from the body, a threaded bore formed on a top portion of the body, a receiving space defined in the body receiving therein a gear assembly;

a gun butt portion having a threaded extension corresponding to and threadingly received in the threaded bore to combine the gun butt portion and the grip portion and a recess defined in the threaded extension receiving therein a recoil mechanism; and a barrel portion detachably connected to the grip portion and having a barrel extending therefrom, a recessed area defined therein receiving a cylinder portion which has a piston movably received therein so as to compress the recoil mechanism when the piston is moved in a first direction and to compress air inside a cylinder when the piston is moved in a second direction;

wherein the piston is reciprocally moved in the first direction and the second direction via the gear assembly in the receiving space of the grip portion, the gear assembly is composed of a motor received in the grip and a driving gear exposed from the receiving space to drive the piston.

2. The gun replica as claimed in claim 1, wherein the recoil mechanism is composed of a guiding rod, a recoil spring mounted around the guiding rod and a distal end thereof is securely engaged with a bottom of the guiding rod and a sleeve securely engaged with a proximal end of the recoil spring to abut a side of the piston.

3. The gun replica as claimed in claim 2, wherein the grip portion has a rear connection hole extending through opposite sides of a rear portion of the body and a front connection hole defined through opposite sides of a front portion of the body, the cylinder has an assembly hole in alignment with the rear connection hole of the grip portion and the barrel portion has a rear assembly hole defined in a rear bottom face of the barrel aligning with the assembly hole of the cylinder portion as well as the rear connection hole of the grip portion and a front assembly hole defined in a front bottom face of the barrel aligning with the front connection hole of the grip portion such that a first pin riveted through the aligned rear connection hole, the assembly hole and the rear assembly hole and a second pin riveted through the aligned front connection hole and the front assembly hole are able to combine the grip portion, the gun butt portion, the cylinder portion, and the barrel portion.

* * * * *